US006347531B1

(12) United States Patent
Roberts et al.

(10) Patent No.: US 6,347,531 B1
(45) Date of Patent: Feb. 19, 2002

(54) SINGLE MIXED REFRIGERANT GAS LIQUEFACTION PROCESS

(75) Inventors: Mark Julian Roberts, Kempton; Rakesh Agrawal, Emmaus; Tamara Lynn Daugherty, Allentown, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/415,636

(22) Filed: Oct. 12, 1999

(51) Int. Cl.[7] ..... F25J 3/00
(52) U.S. Cl. ..... 62/612; 62/613; 62/619
(58) Field of Search ..... 62/611, 612, 613, 62/169

(56) References Cited

U.S. PATENT DOCUMENTS

| | | | | |
|---|---|---|---|---|
| 3,581,511 A | * | 6/1971 | Peck | 62/612 |
| 3,645,106 A | * | 2/1972 | Gaumer, Jr. et al. | 62/612 |
| 3,747,359 A | | 7/1973 | Streich | 62/24 |
| 3,780,535 A | | 12/1973 | Darredeau | 62/40 |
| 3,855,810 A | | 12/1974 | Simon et al. | 62/9 |
| 4,094,655 A | * | 6/1978 | Krieger | 62/612 |
| 4,251,247 A | | 2/1981 | Gauberthier et al. | 62/9 |
| 4,325,231 A | | 4/1982 | Krieger | 62/335 |
| 4,525,185 A | * | 6/1985 | Newton | 62/612 |
| 4,755,200 A | * | 7/1988 | Liu et al. | 62/612 |
| 5,657,643 A | | 8/1997 | Price | 62/612 |

FOREIGN PATENT DOCUMENTS

| | | | |
|---|---|---|---|
| GB | 1435773 | 5/1976 | F25J/1/02 |

OTHER PUBLICATIONS

Bronfenbrenner, J., et al, "LNG Liquefier Cycle Efficiency Analysis", Presented at the Twelfth International Conference on Liquefier Natural Gas, May 1998, Perth, Australia.
European Search Report for application number 00121363.6–2301

* cited by examiner

*Primary Examiner*—Ronald Capossela
(74) *Attorney, Agent, or Firm*—John M. Fernbacher

(57) ABSTRACT

A method of gas liquefaction wherein the refrigeration to cool and liquefy an essentially water-free feed gas is provided by a single recirculating mixed refrigerant cycle in which refrigeration is provided by the vaporization of two mixed refrigerant streams of different compositions at a lower and higher pressure levels respectively. A lower pressure level vaporizing refrigerant cools the feed gas stream in a first cooling zone and a higher pressure level vaporizing refrigerant further cools and condenses the cooled gas in a second cooling zone to provide the final liquid product. The lower pressure level vaporizing refrigerant is provided by one or more liquids obtained by ambient cooling of compressed mixed refrigerant vapor. The vaporized lower pressure level refrigerant can be returned to the refrigerant compressor at a temperature below ambient, without further warming, and this cool refrigerant is compressed and combined with the vaporized higher pressure level refrigerant, which is returned at about ambient temperature.

15 Claims, 4 Drawing Sheets

SINGLE MIXED REFRIGERANT GAS LIQUEFACTION PROCESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The production of liquefied natural gas (LNG) is achieved by cooling and condensing a feed gas stream against multiple refrigerant streams provided by a recirculating refrigeration system. Cooling of the natural gas feed is accomplished by various cooling process cycles such as the well-known cascade cycle in which refrigeration is provided by three different refrigerant loops. One such cascade cycle uses methane, ethylene and propane cycles in sequence to produce refrigeration at three different temperature levels. Another well-known refrigeration cycle uses a propane precooled, mixed refrigerant cycle in which a multicomponent refrigerant mixture generates refrigeration over a selected temperature range. The mixed refrigerant can contain hydrocarbons such as methane, ethane, propane, and other light hydrocarbons, and also may contain nitrogen. Versions of this efficient refrigeration system are used in many operating LNG plants around the world.

Single or double mixed refrigerant cycles, with or without propane precooling, have been used for natural gas liquefaction. Single mixed refrigerant cycles have vaporized the mixed refrigerant either at one or at two different pressure levels to provide refrigeration over the required temperature range.

U.S. Pat. No. 4,251,247 discloses single mixed refrigerant systems in which the refrigerant vaporizes at two pressures. The compressed single mixed refrigerant stream either after compressor interstage cooling and/or after the final compressor stage cooling to near ambient temperature provides a liquid fraction and a vapor fraction. The refrigeration derived from the vapor fraction is used to provide some or all of the cooling of the natural gas from ambient temperature down to near −55° C. The refrigeration from the liquid fraction is used for the cooling of the vapor fraction prior to recovery of the refrigeration from the cooled vapor fraction. In FIG. 4 of this patent, natural gas is first cooled from ambient temperature to an intermediate temperature by refrigeration derived from a combined stream which is derived by combining all of the liquid fraction with a portion of the vapor fraction. In FIG. 5 of this patent, natural gas from ambient temperature is cooled down to 20° C. using refrigeration from a portion of the liquid fraction and is processed in an adsorption unit (dehydrating unit) for water removal. In order to avoid the formation of methane hydrates, natural gas is not cooled to temperatures much below 20° C. prior to the adsorption unit. In order to cool natural gas from 37° C. to 20° C., a portion of the liquid refrigerant fraction is partially vaporized by heat exchange with the natural gas and is returned to a separator located at an interstage of the compressor. However, natural gas exiting the adsorption unit is cooled from 20° C. to −54° C. using refrigeration derived from the vapor fraction of the single mixed refrigerant stream.

A single mixed refrigerant system in which the refrigerant boils at two pressures is described in U.S. Pat. No. 3,747,359. Low pressure mixed refrigerant is compressed warm; that is, it is introduced into the compressor after heat exchange with warm natural gas feed and high pressure mixed refrigerant feeds. Intermediate pressure mixed refrigerant is obtained after cooling below ambient temperature rather than after ambient cooling, and no separation of mixed refrigerant occurs at ambient temperature.

U.S. Pat. No. 4,325,231 discloses a single mixed refrigerant system in which the refrigerant vaporizes at two pressures. The high pressure liquid condensed after ambient cooling is subcooled and vaporized at low pressure, while the high pressure vapor remaining after ambient cooling is further cooled yielding a second liquid and a second vapor stream. The second vapor stream is liquefied, subcooled and vaporized at low pressure, while the second liquid stream is subcooled and vaporized at low and intermediate pressures. Ambient temperature high pressure liquid and high pressure vapor streams are cooled in separate parallel heat exchangers. All vaporized mixed refrigerant streams are warmed to near ambient temperature prior to compression.

U.S. Pat. No. 5,657,643 describes a single mixed refrigerant system in which the refrigerant boils at one pressure. The compression of mixed refrigerant occurs in two stages and yields a liquid condensate after the intercooler which is pumped and mixed with the discharge of the final compression stage. Cooling of the feed and mixed refrigerant occur in a single multi-stream heat exchanger.

Improved efficiency of gas liquefaction processes is highly desirable and is the prime objective of new cycles being developed in the gas liquefaction art. The objectives of the present invention, as described below and as defined by the claims which follow, comprise improvements to liquefaction processes which use a single mixed refrigerant. The improvements include the compression of vaporized refrigerant at reduced compressor inlet temperatures and the generation of interstage liquid refrigerant streams at ambient temperature which can be used beneficially in the refrigeration cycle.

BRIEF SUMMARY OF THE INVENTION

The invention relates to a method for gas liquefaction which comprises:

(a) cooling an essentially water-free feed gas by indirect heat exchange with one or more vaporizing liquid mixed refrigerant streams in a first cooling zone, wherein at least one of the liquid mixed refrigerant streams in the first cooling zone is vaporized at a first pressure level, and withdrawing from the first cooling zone an intermediate cooled feed gas and a first vaporized mixed refrigerant;

(b) further cooling the intermediate cooled feed gas by indirect heat exchange with one or more vaporizing liquid mixed refrigerant streams in a second cooling zone, wherein at least one of the liquid mixed refrigerant streams in the second cooling zone is vaporized at a second pressure level, and withdrawing from the second cooling zone a liquefied gas and a second vaporized mixed refrigerant; and (c) compressing and cooling the first vaporized mixed refrigerant and the second vaporized mixed refrigerant to yield one or more liquid mixed refrigerant streams, wherein the cooling is ambient cooling effected by heat transfer to an ambient heat sink.

The one or more vaporizing liquid mixed refrigerant streams utilized to cool the feed gas in the first cooling zone of (a) may be derived solely from the one or more liquid mixed refrigerant streams of (c).

The vaporizing liquid mixed refrigerant streams in the first and second cooling zones may be provided in a recirculating refrigeration process which includes the steps of:

(1) compressing the second vaporized mixed refrigerant to a first pressure level to yield a pressurized second mixed refrigerant;

(2) combining the pressurized second mixed refrigerant with the first vaporized mixed refrigerant and compressing the resulting combined refrigerant stream to yield a compressed mixed refrigerant stream;

(3) cooling and partially condensing the compressed mixed refrigerant stream by ambient cooling to yield a mixed refrigerant vapor and a mixed refrigerant liquid;

(4) subcooling and reducing the pressure of the mixed refrigerant liquid to provide a vaporizing liquid mixed refrigerant stream in the first cooling zone at the first pressure level; and (5) cooling, at least partially condensing, and reducing the pressure of the mixed refrigerant vapor to provide a vaporizing liquid mixed refrigerant which is vaporized in the second cooling zone at a second pressure level;

The compression of the combined regrigerant stream in (2) may be effected in multiple stages of compression, and an interstage vapor refrigerant stream may be cooled and partially condensed by ambient cooling to yield an additional mixed refrigerant liquid.

The essentially water-free feed gas may be provided by removing water from a natural gas feed stream. Optionally, the additional mixed refrigerant liquid can be pressurized by pumping and the resulting pressurized liquid combined with the compressed mixed refrigerant stream. If desired, the additional mixed refrigerant liquid can be subcooled and reduced in pressure to provide another vaporizing liquid mixed refrigerant stream in the first cooling zone.

A portion of the refrigeration for cooling and partially condensing the mixed refrigerant vapor in (e) above can be provided by the vaporizing liquid mixed refrigerant stream in the first cooling zone. Another portion of the refrigeration for cooling and partially condensing the mixed refrigerant vapor in (e) can be provided at least in part by the vaporizing liquid mixed refrigerant stream in the second cooling zone. At least a portion of the refrigeration for subcooling of the mixed refrigerant liquid in (d) can be provided by the vaporizing liquid mixed refrigerant stream in the first cooling zone. The refrigeration for subcooling the additional mixed refrigerant liquid can be provided at least in part by the vaporizing liquid mixed refrigerant stream in the first cooling zone.

In an optional embodiment, the mixed refrigerant vapor can be cooled, partially condensed, and separated into a second mixed refrigerant vapor and a second mixed refrigerant liquid. The second mixed refrigerant liquid can be subcooled and reduced in pressure to provide a vaporizing liquid mixed refrigerant stream in the second cooling zone. The refrigeration for subcooling the second mixed refrigerant liquid can be provided in part by the vaporizing liquid mixed refrigerant stream which is vaporized in the second cooling zone. The second mixed refrigerant vapor can be cooled, at least partially condensed, and reduced in pressure to provide another vaporizing liquid mixed refrigerant stream in the second cooling zone.

The refrigeration for cooling the second mixed refrigerant vapor can be provided at least in part by the vaporizing liquid mixed refrigerant stream in the second cooling zone. A portion of the mixed refrigerant liquid after subcooling in (d) can be combined with the second mixed refrigerant liquid, and the resulting combined stream can be subcooled, reduced in pressure, and vaporized at the second pressure level in the second cooling zone.

The intermediate cooled feed gas preferably is at a temperature below about 10° C.

DETAILED DESCRIPTION OF THE INVENTION

The current invention provides an efficient process for the liquefaction of a feed gas stream and is particularly applicable to the liquefaction of natural gas. The invention achieves high thermodynamic efficiency with a simple, single mixed refrigerant process requiring a minimum number of heat exchangers. In a preferred mode, the invention utilizes a recirculating refrigeration system with a single mixed refrigerant which cools the feed gas stream by indirect heat transfer with vaporizing mixed refrigerant streams at two pressure levels. The mixed refrigerant is a multicomponent fluid mixture typically containing one or more hydrocarbons selected from methane, ethane, propane, and other light hydrocarbons, and also may contain nitrogen.

The invention in the embodiments described below can utilize any of a wide variety of heat exchange devices in the refrigeration circuits including wound coil, plate-fin, shell and tube, and kettle type heat exchangers. Combinations of these types of heat exchangers can be used depending upon specific applications. The invention can be used to liquefy any gas feed stream, but preferably is used to liquefy natural gas as illustrated in the following process descriptions.

Figure 1:
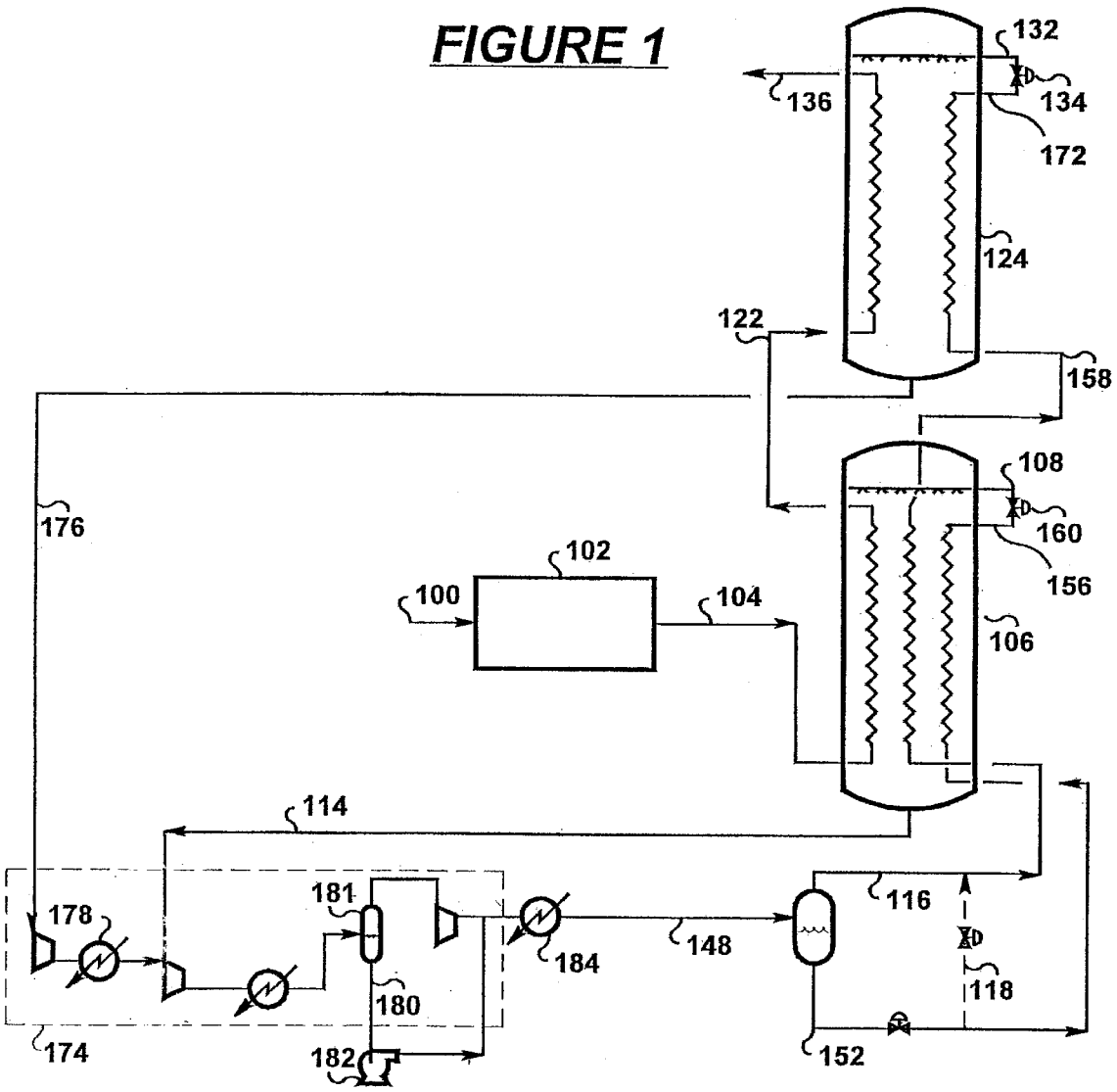
FIG. 1 is a schematic flow diagram of an embodiment of the present invention wherein a portion of the recirculating vaporized refrigerant is compressed cold and an interstage refrigerant liquid is formed during compression.

Referring to FIG. 1, gas stream 100, preferably natural gas, is cleaned and dried by known methods in pretreatment section 102 to remove water, acid gases such as $CO_2$ and $H_2S$, and other contaminants such as mercury. Pretreated feed gas stream 104, which is now essentially water-free, is cooled in heat exchanger 106 to an intermediate temperature between about 10° C. and −90° C., preferably between about 0° C. and −50° C., by vaporizing mixed refrigerant stream 108. The term "essentially water-free" means that any residual water in feed gas stream 104 is present at a sufficiently low concentration to prevent operational problems due to water freezeout in the downstream cooling and liquefaction process.

Cooled natural gas stream 122 is further cooled in heat exchanger 124 to a temperature between about −190° C. and −120° C., preferably between about −170° C. and −150° C.

by vaporizing mixed refrigerant stream 132. The resulting further cooled stream 136 is product liquefied natural gas (LNG) which is sent to a storage tank or to further processing.

Refrigeration to cool the natural gas feed stream 104 from near ambient to a final product condensate temperature is provided by a mixed refrigeration circuit which utilizes a refrigerant containing two or more components. Pressurized mixed refrigerant stream 148 is provided by multistage compressor 174 at a pressure between about 25 bara and 100 bara, and preferably between about 40 bara and 80 bara. After ambient cooling, this compressed and partially condensed stream is separated into vapor stream 116 and liquid stream 152. Optionally, a portion 118 of liquid stream 152 may be combined with vapor stream 116.

The term "ambient cooling" means cooling which is effected by heat transfer to an ambient heat sink by utilizing indirect heat transfer with an ambient temperature fluid such as cooling water or ambient air. Heat extracted from the cooled stream thus is ultimately rejected to an ambient heat sink such as atmospheric air or a large body of water.

The liquid and vapor mixed refrigerant streams 116 and 152 then enter heat exchanger 106 at near ambient temperature. The refrigerant streams are cooled to a temperature between about 10° C. and −90° C., preferably between about 0° C. and −50° C., in heat exchanger 106, exiting as streams 156 and 158. Stream 156 is reduced in pressure adiabatically across throttling valve 160 to a pressure level between about 4 bara and 30 bara, preferably between about 8 bara and 20 bara, and introduced into the cold end of heat exchanger 106 as stream 108 to provide refrigeration as described earlier. Vaporized refrigerant stream 114 is withdrawn from heat exchanger 106 at or near ambient temperature. If desired, the pressure of stream 156 could be reduced by work expansion in a turboexpander.

Mixed refrigerant stream 158 is introduced into heat exchanger 124 and cooled therein to a final temperature between about −190° C. and −120° C., preferably between about −170° C. and −150° C. Subcooled liquid stream 172 is then reduced in pressure adiabatically across throttling valve 134 to a pressure level between about 1 bara and 10 bara, preferably between about 2 bara and 6 bara, and is introduced to the cold end of heat exchanger 124 as stream 132 to provide refrigeration therein. If desired, the pressure of stream 172 could be reduced by work expansion in a turboexpander.

The two vaporized refrigerant streams, 176 and 114, are returned to compressor 174. Stream 176, which is still relatively cold, is cold compressed in a first compression stage to a pressure between approximately 4 bara and 30 bara and preferably between 8 bara and 20 bara. Stream 176 preferably is colder than stream 114, which typically is much closer to ambient temperature. The compression of a vaporized refrigerant stream which is returned at a sub-ambient temperature is defined as cold compression, and is beneficial because it allows a reduction in the size of heat exchanger 106 and the compressor size as a result of higher gas density and lower volumetric flow rate.

The term "pressure level" as used herein defines fluid pressures in the piping and heat exchanger passages of a refrigeration circuit wherein the fluid pressures are between the discharge pressure of an expansion device and the suction pressure of a compression device. In FIG. 1, for example, one pressure level exists by definition in the piping and heat exchanger passages downstream of throttling valve 160 and upstream of the inlet of the second stage of compressor 174. Because of pressure drop in the equipment, the actual pressure of the flowing fluid at any point in this region varies between the pressure at the outlet of throttling valve 160 and the pressure at the inlet of the second stage of compressor 174. Likewise, another pressure level exists by definition in the piping and heat exchanger passages downstream of throttling valve 134 and upstream of the inlet of the first stage stage of compressor 174.

Optionally, the refrigerant stream after a first stage of compression can be cooled in cooler 178 by ambient cooling. Cooler 178 is optional and may be omitted to save capital cost. The discharge of the first compression stage is combined with vaporized mixed refrigerant stream 114 and the combined stream is further compressed in one or more additional compression stages to a final high pressure between about 25 bara and 100 bara, and preferably between about 40 bara and 80 bara.

In this compression step, at least one liquid stream 180 optionally can result after intercooling. In this embodiment, optional liquid stream 180 is generated, pumped to the final high pressure in pump 182, and combined with the compressed gas stream from the final compression stage. The combined refrigerant stream is cooled in cooler 184 by ambient cooling.

In FIG. 1, heat exchanger 106 is a first cooling zone which supplies the first stage of cooling for the feed has in line 104, and also cools vapor refrigerant stream 116 and liquid refrigerant stream 152. In this heat exchanger, at least a portion of and preferably all of the refrigeration is provided by vaporizing at least a portion of subcooled liquid stream 156 after pressure reduction across valve 160. Refrigerant stream 156 can be derived from the ambient cooling in cooler 184 of the compressed refrigerant from compressor 174. Vapor stream 116 does not provide any cooling duty in heat exchanger 106, but is itself cooled by the refrigeration derived from vaporizing liquid refrigerant stream 108. Vapor stream 116 after cooling and condensation preferably is used to provide refrigeration in the second stage of cooling in heat exchanger 124. The vaporized refrigeration stream 176 is not sent through heat exchanger 106 and therefore refrigeration contained in this stream is not used for cooling the feed gas in the first stage of cooling.

Figure 2:
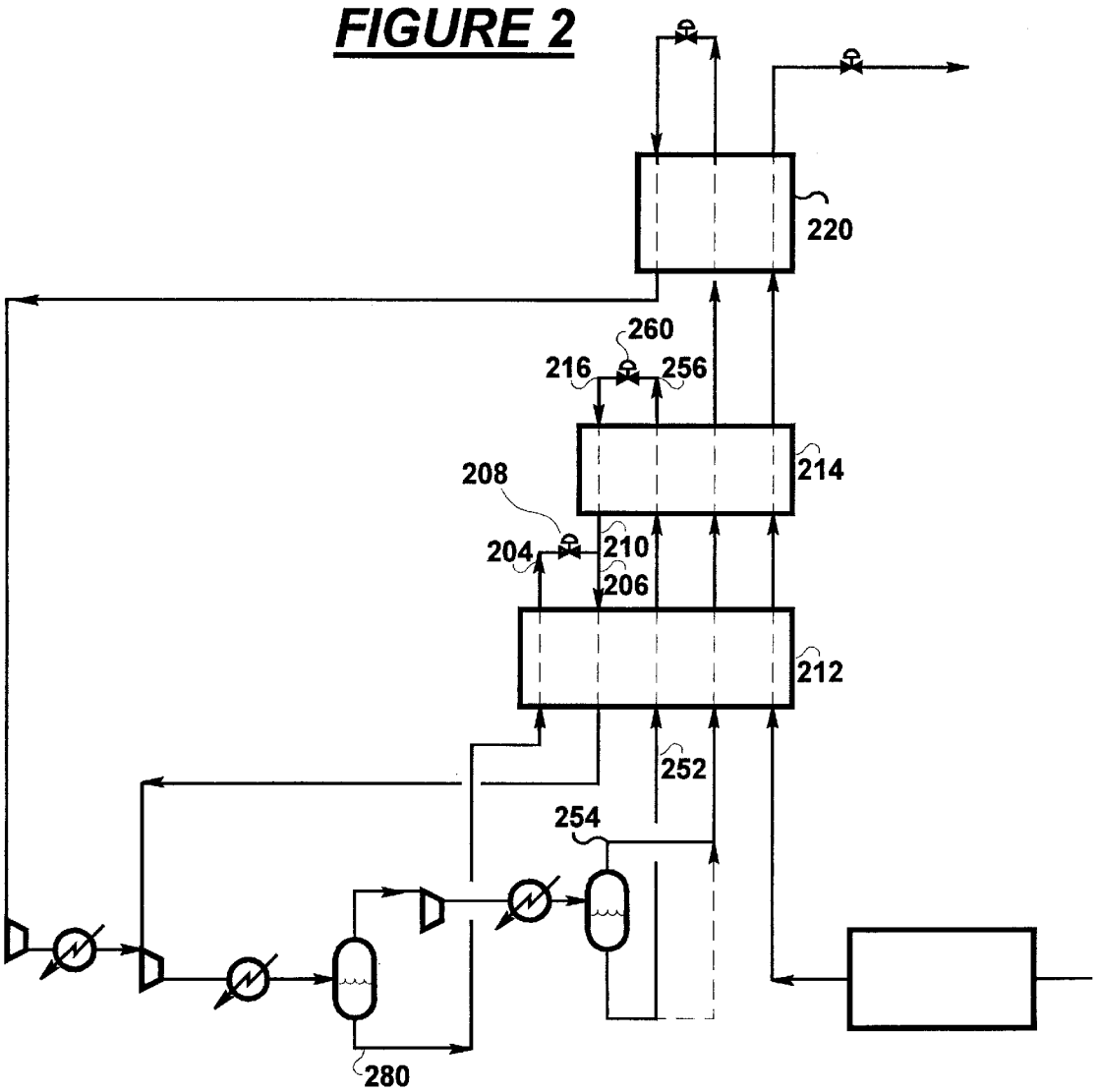
FIG. 2 is a schematic flow diagram of another embodiment of the present invention wherein an interstage refrigerant liquid is formed during compression, subcooled, reduced in pressure, and vaporized to provide refrigeration.

Another embodiment is illustrated in FIG. 2 in which liquid stream 280 is not pumped as in the previous embodiment, but instead is subcooled in heat exchanger 212. In this embodiment, the single heat exchanger 106 of FIG. 1 is replaced by two exchangers, 212 and 214. Liquid stream 280 is subcooled in exchanger 212 to yield subcooled liquid stream 204. Stream 204 is reduced in pressure adiabatically across throttling valve 208, combined with refrigerant stream 210 (later described), and introduced into the cold end of heat exchanger 212 as stream 206 where it vaporizes at a defined pressure level to provide refrigeration therein. Alternatively, the pressure of stream 204 could be reduced across a work expander.

Liquid stream 252 is subcooled in heat exchangers 212 and 214 to yield subcooled liquid stream 256, which is reduced in pressure adiabatically across throttling valve 260 and introduced into the cold end of exchanger 214 as stream 216 which vaporizes at a another pressure level to provide refrigeration therein. Alternatively, the pressure of stream 256 can be reduced across a work expander. Partially warmed refrigerant stream 210 is combined with the reduced-pressure refrigerant stream from throttling valve 208 as described earlier. In this embodiment, a defined pressure level occurs in the piping and heat exchanger passages downstream of throttling valves 208 and 260 and upstream of the inlet to the second compressor stage.

In FIG. 2, heat exchangers 212 and 214 provide the needed first stage of cooling the feed gas to temperatures below about 10° C., preferably below about 0° C., and more preferably below about −20° C. In this first stage of cooling, a portion or preferably all of the refrigeration for cooling of feed gas 104, liquid stream 252, and vapor stream 254 is provided by the vaporization of a liquid refrigerant stream derived by ambient cooling. In this example, two liquid streams 280 and 252 are derived at near-ambient temperature by ambient cooling, and both of these streams are used to provide the needed refrigeration in the first stage of cooling. Vapor stream 254 is cooled in the first stage of cooling but provides refrigeration to the feed gas only in the second stage of cooling in heat exchanger 220.

Figure 3:
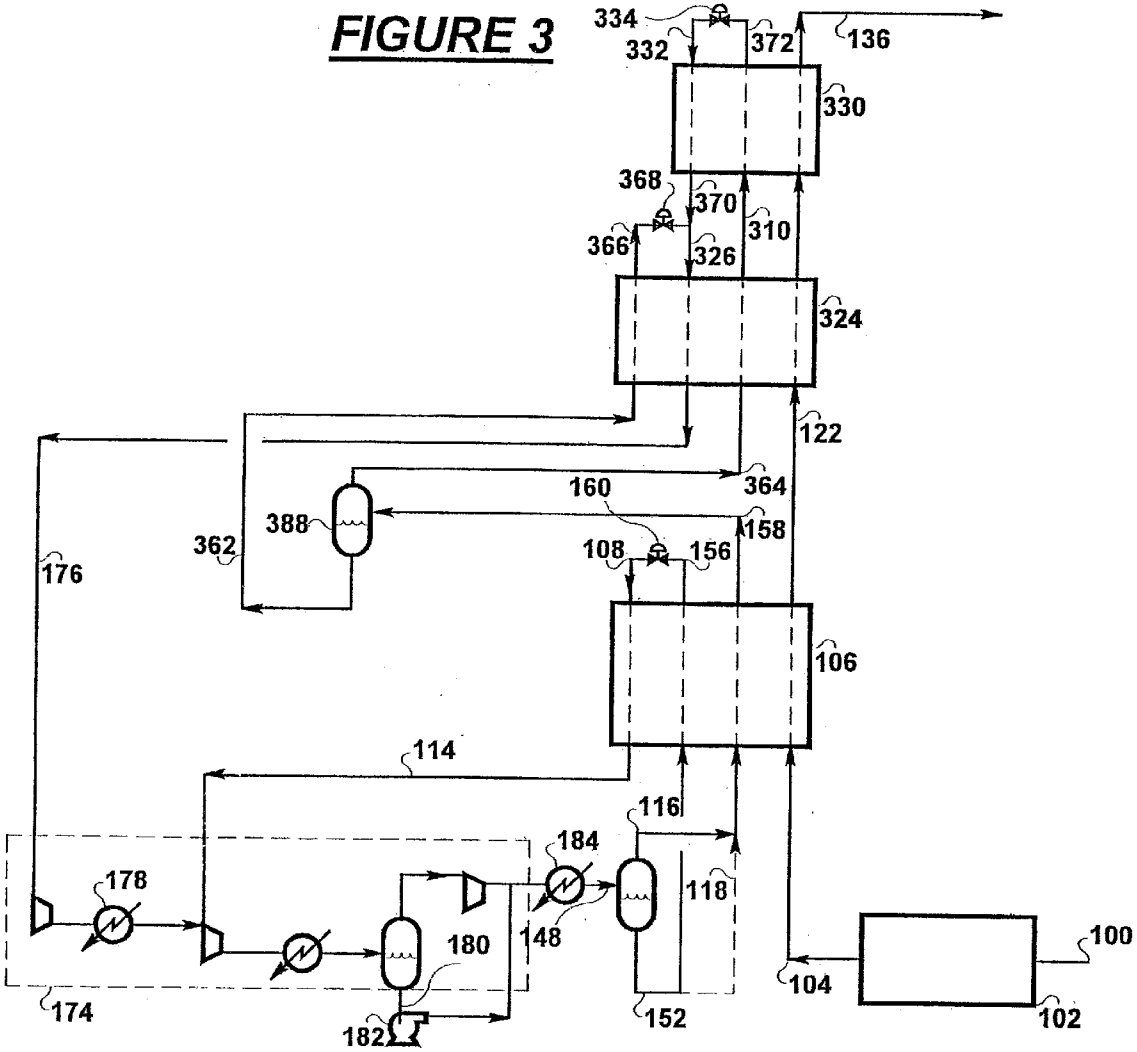
FIG. 3 is a schematic flow diagram of another embodiment of the present invention wherein a refrigerant vapor stream is partially condensed at subambient temperature to form cooled vapor and liquid refrigerant streams.

FIG. 3 illustrates a preferred embodiment of the present invention which is a modification of the embodiment of FIG. 1. In this embodiment vapor refrigerant stream 116 is partially condensed in heat exchanger 106, and resulting two-phase stream 158 is separated into liquid stream 362 and vapor stream 364 in separator 388. In this embodiment, heat exchanger 124 of FIG. 1 is replaced by heat exchangers 324 and 330. The feed gas is further cooled in the second stage of cooling in heat exchangers 324 and 330.

Liquid stream 362 is subcooled in heat exchanger 324 to yield subcooled stream 366 at a temperature between about −150° C. and about −70° C., preferably between about −145° C. and −100° C. This stream is reduced in pressure across throttling valve 368 to a pressure level between about 1 bara and about 10 bara, preferably between about 2 bara and about 6 bara, and is combined with stream 370 (later described). Alternatively, the pressure of stream 366 could be reduced across a work expander. Combined stream 326 is vaporized in exchanger 324 at a defined pressure level to provide refrigeration therein. Vaporized refrigerant stream 176, at a temperature below ambient and possibly at a temperature as low as −90° C., is introduced into compressor 174.

Vapor refrigerant stream 364 is introduced to exchanger 324 where it is cooled to a temperature between about −150° C. and about −70° C., preferably between about −145° C. and about −100° C. Resulting cooled stream 310 is introduced into exchanger 330 where it is cooled to a final temperature between about −190° C. and about −120° C., and preferably between about −170° C. and about −150° C. Subcooled liquid stream 372 is reduced in pressure adiabatically across throttling valve 334 to a pressure level between about 1 bara and about 10 bara, preferably between about 2 bara and about 6 bara, and is introduced into the cold end of exchanger 330 as stream 332 where it is vaporized at the defined pressure level to provide refrigeration therein. Alternatively, the pressure of stream 372 could be reduced across a work expander. Partially warmed refrigerant stream 370 is combined with the reduced-pressure refrigerant stream from throttling valve 368 as earlier described. In this embodiment, the defined pressure level occurs in the piping and heat exchanger passages downstream of throttling valves 334 and 368 and upstream of the inlet to the first stage of compressor 174. The other steps in the embodiment of FIG. 3 are the same as those described in FIG. 1.

Figure 4:
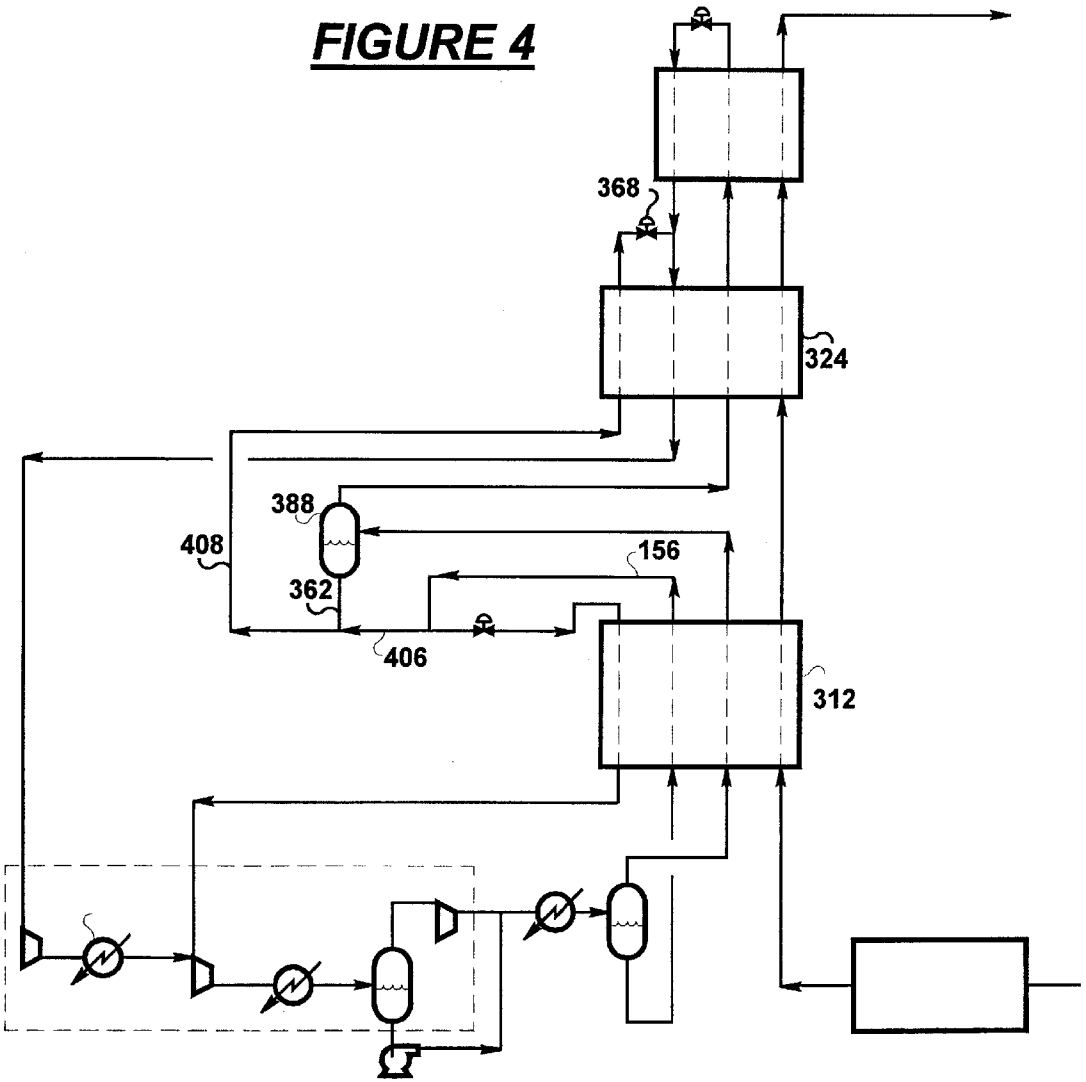
FIG. 4 is a schematic flow diagram illustrating a modification of the embodiment of FIG. 3 in which a portion of a subcooled mixed refrigerant liquid is combined with a mixed refrigerant liquid obtained by partially condensing a refrigerant vapor.

FIG. 4 illustrates another embodiment of the invention which is a modification of FIG. 3. In the embodiment of FIG. 4, a portion 406 of subcooled liquid stream 156 from heat exchanger 312 is combined with liquid stream 362 from separator 388. Combined liquid stream 408 is subcooled in heat exchanger 324 and reduced in pressure across throttling valve 368 as described earlier. The other steps in the embodiment of FIG. 4 are the same as those described in FIG. 3.

The invention in the embodiments of FIGS. 1–4 described above can utilize any of a wide variety of heat exchange devices in the refrigeration circuits including wound coil, plate-fin, shell and tube, and kettle type heat exchangers. Combinations of these types of heat exchangers can be used depending upon specific applications.

In the above embodiments, steps for heavier hydrocarbon removal from the feed gas were not included. In some cases, however, depending on feed composition and product specifications, such removal steps can be required. These heavy component removal steps may be employed at any suitable temperature above the final liquefied product temperature using any one of several methods well-known in the art. For example, such heavier hydrocarbons may be removed using a scrub column after the first cooling stage. In this scrub column, the heavier components of the natural gas feed, for example pentane and heavier components, are removed. The scrub column may utilize only a stripping section, or may include a rectifying section with a condenser for removal of heavy contaminants such as benzene to very low levels. When very low levels of heavy components are required in the final LNG product, any suitable modification to the scrub column can be made. For example, a heavier component such as butane may be used as the wash liquid.

Impurities such as water and carbon dioxide in the natural gas must be removed prior to its liquefaction as earlier described. Generally these impurities are removed by using an adsorption unit within pretreatment section 102. If needed, natural gas stream 100 can be precooled prior to the adsorption unit. Such precooling will generally be in the neighborhood of 20° C. to avoid methane hydrate formation. This precooling can be provided by at least a portion of the liquid refrigerant stream collected after ambient cooling of the compressed mixed refrigerant stream. Thus in FIG. 1, a portion of liquid stream 152 may be reduced in pressure and partially vaporized to cool either stream 100 or 104 (not shown) and the resulting warmed stream returned to separator 181. After precooling, the natural gas is sent to pretreatment section 102 to remove water and other contaminants. The essentially water-free feed gas 104 is sent to the first stage of cooling in heat exchanger 106 where it is cooled to a temperature below about 10° C., preferably below about 0° C., and more preferably below about −20° C.

EXAMPLE

Referring to FIG. 3, natural gas feed stream 100 is cleaned and dried in pretreatment section 102 for the removal of water, acid gases such as $CO_2$ and $H_2S$, and other contaminants such as mercury. Pretreated feed gas 104 has a flow rate of 26,700 kg-mole/hr, a pressure of 66.5 bara, a temperature of 32° C., and a molar composition as follows:

TABLE 1

Feed Gas Composition

| Component | Mole Fraction |
|---|---|
| Nitrogen | 0.009 |
| Methane | 0.940 |
| Ethane | 0.031 |

TABLE 1-continued

| Feed Gas Composition | |
|---|---|
| Component | Mole Fraction |
| Propane | 0.013 |
| i-Butane | 0.003 |
| Butane | 0.004 |

Pretreated gas 104 enters the first exchanger 106 and is cooled to a temperature of −21° C. The cooling is effected by the warming of mixed refrigerant stream 108, which has a flow of 30,596 kg-mole/hr at a pressure of about 13 bara and the following composition:

TABLE 2

| Refrigerant Composition | |
|---|---|
| Component | Mole Fraction |
| Nitrogen | 0.021 |
| Methane | 0.168 |
| Ethane | 0.353 |
| Propane | 0.347 |
| Butane | 0.111 |

Cooled stream 122 is then further cooled in exchanger 324 to a temperature of −133° C. by warming mixed refrigerant stream 326 which enters exchanger 324 at a pressure level of about 3 bara. The resulting cooled stream 328 is then further cooled to a temperature of −166° C. in exchanger 330. Refrigeration for cooling in exchanger 330 is provided by mixed refrigerant stream 332 vaporizing at a pressure level of about 3 bara. Resulting LNG product stream 136 is sent to storage or to further treatment.

Refrigeration to cool the natural gas stream 104 from near ambient to a final product temperature is provided by a recirculating mixed refrigeration circuit. Stream 148 is the high pressure mixed refrigerant exiting multistage compressor 174 at a pressure of 60 bara, a flow rate of 67,900 kg-moles/hr, and the following composition:

TABLE 3

| Refrigerant Composition | |
|---|---|
| Component | Mole Fraction |
| Nitrogen | 0.057 |
| Methane | 0.274 |
| Ethane | 0.334 |
| Propane | 0.258 |
| Butane | 0.077 |

Stream 148 is separated into vapor stream 116 and liquid stream 152. Portion 118, which is 16% of liquid stream 152, is re-combined with vapor stream 116. The liquid and vapor mixed refrigerant streams then enter heat exchanger 106 at a temperature of 32° C. The refrigerant streams are cooled therein to a temperature of −21° C., leaving as cooled refrigerant streams 156 and 158. Stream 156 is reduced in pressure adiabatically across throttling valve 160 to a pressure level of approximately 13 bara and introduced into the cold end of exchanger 106 as stream 108 to provide refrigeration therein.

Stream 158 is separated into liquid stream 362 and vapor stream 364, and the streams are introduced into exchanger 324 where they are cooled to a temperature of −133° C. Subcooled liquid stream 366 is reduced in pressure adiabatically across throttling valve 368 to a pressure of about 3 bara and introduced into the cold end of exchanger 324 as stream 326 to provide refrigeration therein by vaporization at a defined pressure level.

Stream 310 is introduced into exchanger 330 where it is cooled to a final temperature of −166° C. in heat exchanger 330. Subcooled liquid stream 372 is then reduced in pressure adiabatically across throttling valve 334 to a pressure level of approximately 3 bara and introduced to the cold end of exchanger 330 as stream 332 to provide refrigeration therein.

Two vaporized refrigerant streams 176 and 114 are fed to compressor 174. Stream 176 is compressed in a first compression stage to a pressure of approximately 13 bara and cooled to 32° C. against an ambient heat sink in cooler 178. The discharge of the first compression stage is combined with vaporized refrigerant stream 114 and compressed in two compression stages to a final high pressure of 60 bara. In this compression step, liquid stream 180 is generated after intercooling. Liquid stream 180, which has a flow of 5600 kg-mole/hr and a pressure of 27 bara, is pumped in pump 182 to the final high pressure and is combined with the stream exiting the final compression stage before ambient cooler 184.

Thus the present invention is a method of gas liquefaction wherein the refrigeration to cool and liquefy the feed gas is provided by a single recirculating mixed refrigerant cycle in which refrigeration is provided by the vaporization of two mixed refrigerant streams of different compositions, one at a low pressure level and the other at an intermediate, higher pressure level. Various compositions and flows of liquid and vapor refrigerant streams are provided by one or more fractional condensation steps applied to vapor refrigerant streams. The intermediate-pressure vaporizing refrigerant provides the first stage of cooling for the gas feed stream, and the low-pressure vaporizing refrigerant further cools and condenses the gas in the second stage of cooling to provide the final liquid product.

In a preferred feature of the invention, one or more liquid refrigerant streams are subcooled and vaporized at an intermediate pressure level to provide refrigeration for cooling the feed gas in the first stage of cooling, and these liquid refrigerant streams are derived solely from ambient cooling of compressed refrigerant vapor.

Returning the low-pressure mixed refrigerant at a sub-ambient temperature to the compression step, rather than further warming this refrigerant to ambient temperature prior to compression, reduces the size of heat exchange and compression equipment, or alternatively allows increased production at a fixed heat exchanger size. The generation of an interstage liquid refrigerant stream during compression offers increased process efficiency. The combination of cold compression and the generation of an interstage refrigerant liquid provides improved process efficiency, increased production, and/or decreased capital investment.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed:

1. A method for gas liquefaction which comprises:

(a) cooling an essentially water-free feed gas by indirect heat exchange with one or more vaporizing liquid mixed refrigerant streams in a first cooling zone, wherein at least one of the liquid mixed refrigerant streams in the first cooling zone is vaporized at a first pressure level, and withdrawing from the first cooling zone an intermediate cooled feed gas and a first vaporized mixed refrigerant;

(b) further cooling the intermediate cooled feed gas by indirect heat exchange with one or more vaporizing liquid mixed refrigerant streams in a second cooling zone, wherein at least one of the liquid mixed refrigerant streams in the second cooling zone is vaporized at a second pressure level, and withdrawing from the second cooling zone a liquefied gas and a second vaporized mixed refrigerant; and (c) compressing and cooling the first vaporized mixed refrigerant and the second vaporized mixed refrigerant to yield one or more liquid mixed refrigerant streams, wherein the cooling is ambient cooling effected by heat transfer to an ambient heat sink;

wherein the one or more vaporizing liquid mixed refrigerant streams utilized to cool the feed gas in the first cooling zone of (a) are derived solely from the one or more liquid mixed refrigerant streams of (c), and wherein the vaporizing liquid mixed refrigerant streams in the first and second cooling zones are provided in a recirculating refrigeration process which includes the steps of:

(1) compressing the second vaporized mixed refrigerant to a first pressure level to yield a pressurized second mixed refrigerant;

(2) combining the pressurized second mixed refrigerant with the first vaporized mixed refrigerant and compressing the resulting combined refrigerant stream to yield a compressed mixed refrigerant stream;

(3) cooling and partially condensing the compressed mixed refrigerant stream by ambient cooling to yield a mixed refrigerant vapor and a mixed refrigerant liquid;

(4) subcooling and reducing the pressure of the mixed refrigerant liquid to provide a vaporizing liquid mixed refrigerant stream in the first cooling zone at the first pressure level; and (5) cooling, at least partially condensing, and reducing the pressure of the mixed refrigerant vapor to provide a vaporizing liquid mixed refrigerant which is vaporized in the second cooling zone at a second pressure level;

wherein the compression of the combined refrigerant stream in (2) is effected in multiple stages of compression, and wherein an interstage vapor refrigerant stream is cooled and partially condensed by ambient cooling to yield an additional mixed refrigerant liquid.

2. The method of claim 1 wherein the essentially water-free feed gas is provided by removing water from a natural gas feed stream.

3. The method of claim 1 wherein the additional mixed refrigerant liquid is pressurized by pumping and the resulting pressurized liquid is combined with the compressed mixed refrigerant stream.

4. The method of claim 1 wherein a portion of the refrigeration for cooling and partially condensing the mixed refrigerant vapor in (e) is provided by the vaporizing liquid mixed refrigerant stream in the first cooling zone.

5. The method of claim 4 wherein another portion of the refrigeration for cooling and partially condensing the mixed refrigerant vapor in (e) is provided at least in part by the vaporizing liquid mixed refrigerant stream in the second cooling zone.

6. The method of claim 4 wherein at least a portion of the refrigeration for subcooling of the mixed refrigerant liquid in (d) is provided by the vaporizing liquid mixed refrigerant stream in the first cooling zone.

7. The method of claim 1 wherein the additional mixed refrigerant liquid is subcooled and reduced in pressure to provide another vaporizing liquid mixed refrigerant stream in the first cooling zone.

8. The method of claim 7 wherein the refrigeration for subcooling the additional mixed refrigerant liquid is provided at least in part by the vaporizing liquid mixed refrigerant stream in the first cooling zone.

9. The method of claim 1 wherein the mixed refrigerant vapor is cooled, partially condensed, and separated into a second mixed refrigerant vapor and a second mixed refrigerant liquid.

10. The method of claim 9 wherein the second mixed refrigerant liquid is subcooled and reduced in pressure to provide a vaporizing liquid mixed refrigerant stream in the second cooling zone.

11. The method of claim 10 wherein a portion of the mixed refrigerant liquid after subcooling in (d) is combined with the second mixed refrigerant liquid, and the resulting combined stream is subcooled, reduced in pressure, and vaporized at the second pressure level in the second cooling zone.

12. The method of claim 10 wherein the refrigeration for subcooling the second mixed refrigerant liquid is provided in part by the vaporizing liquid mixed refrigerant stream which is vaporized in the second cooling zone.

13. The method of claim 10 wherein the second mixed refrigerant vapor is cooled, at least partially condensed, and reduced in pressure to provide another vaporizing liquid mixed refrigerant stream in the second cooling zone.

14. The method of claim 13 wherein the refrigeration for cooling the second mixed refrigerant vapor is provided at least in part by the vaporizing liquid mixed refrigerant stream in the second cooling zone.

15. The method of claim 1 wherein the intermediate cooled feed gas is at a temperature below about 10° C.

* * * * *